US012345489B2

(12) United States Patent
Maughan et al.

(10) Patent No.: US 12,345,489 B2
(45) Date of Patent: Jul. 1, 2025

(54) TRIGGER MECHANISM FOR A FIREARM

(71) Applicant: BROWNING, Morgan, UT (US)

(72) Inventors: Robert G. Maughan, Layton, UT (US); Ryan D. Cook, Morgan, UT (US)

(73) Assignee: BROWNING, Morgan, UT (US)

( * ) Notice: Subject to any disclaimer, the term of this patent is extended or adjusted under 35 U.S.C. 154(b) by 145 days.

(21) Appl. No.: 17/951,465

(22) Filed: Sep. 23, 2022

(65) Prior Publication Data

US 2023/0136519 A1 May 4, 2023

Related U.S. Application Data

(62) Division of application No. 17/515,009, filed on Oct. 29, 2021, now abandoned.

(51) Int. Cl.
*F41A 19/31* (2006.01)

(52) U.S. Cl.
CPC ..... *F41A 19/31* (2013.01)

(58) Field of Classification Search
CPC ..... F41A 19/10; F41A 19/12; F41A 19/16; F41A 19/31; F41A 19/32
See application file for complete search history.

(56) References Cited

U.S. PATENT DOCUMENTS 1,356,779 A 10/1920 Miller
2,043,281 A * 6/1936 Burton ..... F41A 17/64 42/70.08
2,098,137 A * 11/1937 Elfstrom ..... F41A 17/64 42/16
2,126,076 A * 8/1938 Wright ..... F41A 19/16 42/69.02
2,249,231 A * 7/1941 Smith ..... F41A 19/16 74/2
2,249,232 A * 7/1941 Smith ..... F41A 19/31 74/2

(Continued)

FOREIGN PATENT DOCUMENTS

DE 962504 C * 4/1957
DE 3535012 C2 * 6/1995 ..... F41A 19/16

(Continued)

OTHER PUBLICATIONS

Ackle. DE 3535012 C2. Machine Translation by <https://worldwide.espacenet.com>. Jun. 29, 1995. (Year: 1995).*

(Continued)

*Primary Examiner* — Gabriel J. Klein
(74) *Attorney, Agent, or Firm* — DORSEY & WHITNEY LLP

(57) ABSTRACT

Embodiments of the present disclosure relate to trigger mechanisms for firearms. In one aspect of the present disclosure, the trigger mechanism can include a linkage between a striker sear and a main sear to control an amount of force exerted on the main sear by the striker sear. A portion of the force exerted on the striker sear by the striker can be exerted on the main sear through the sear linkage. In another aspect of the present disclosure, trigger mechanisms are described which additionally, or alternatively utilize one or more biasing members to provide a variable trigger pull weight.

18 Claims, 12 Drawing Sheets

(56) References Cited

U.S. PATENT DOCUMENTS

| | | | | | |
|---|---|---|---|---|---|
| 2,346,484 | A * | 4/1944 | Gradle | F41A 19/16 | 42/69.02 |
| 2,437,548 | A | 3/1948 | William | | |
| 2,514,981 | A * | 7/1950 | Walker | F41A 17/32 | 42/70.01 |
| 2,547,180 | A | 4/1951 | Taylor | | |
| 2,584,299 | A * | 2/1952 | Sefried | F41A 19/31 | 42/69.02 |
| 2,856,717 | A * | 10/1958 | Parke | F41A 19/17 | 42/16 |
| 3,103,758 | A * | 9/1963 | Wilhelm | F41A 19/59 | 42/69.02 |
| 3,550,301 | A * | 12/1970 | Shesterikov | F41A 19/16 | 42/69.01 |
| 3,726,040 | A | 4/1973 | Cranston | | |
| 3,747,251 | A | 7/1973 | Baker | | |
| 3,755,951 | A * | 9/1973 | Koon, Jr. | F41A 19/16 | 42/69.01 |
| 5,081,780 | A | 1/1992 | Lishness et al. | | |
| 5,105,570 | A | 4/1992 | Lishness et al. | | |
| 5,487,233 | A * | 1/1996 | Jewell | F41A 19/16 | 42/69.01 |
| 5,937,842 | A | 8/1999 | Summers et al. | | |
| 6,763,819 | B2 | 7/2004 | Eckert | | |
| 7,181,880 | B2 | 2/2007 | Keeney | | |
| 7,314,045 | B2 | 1/2008 | Eckert et al. | | |
| 7,743,543 | B2 | 6/2010 | Karagias | | |
| 8,109,025 | B2 | 2/2012 | Stone | | |
| 8,132,349 | B1 | 3/2012 | Huber | | |
| 8,495,831 | B1 | 7/2013 | Kohout | | |
| 8,522,466 | B2 | 9/2013 | Arduini | | |
| 8,522,765 | B1 | 9/2013 | Lorocco et al. | | |
| 8,997,390 | B1 | 4/2015 | Heizer | | |
| 9,097,485 | B2 | 8/2015 | Lipowski | | |
| 9,404,701 | B2 | 8/2016 | Lipowski | | |
| 9,435,599 | B2 | 9/2016 | Heizer et al. | | |
| 9,494,379 | B2 | 11/2016 | Yehle | | |
| 9,752,841 | B2 | 9/2017 | Lipowski | | |
| 11,015,894 | B1 * | 5/2021 | Malina | F41A 19/16 | |
| 2019/0072350 | A1 * | 3/2019 | Ostanin | F41A 19/32 | |
| 2019/0195588 | A1 * | 6/2019 | Lake | F41A 19/10 | |
| 2020/0363154 | A1 * | 11/2020 | Lake | F41A 17/46 | |

FOREIGN PATENT DOCUMENTS

| | | | | |
|---|---|---|---|---|
| DE | 20101250 U1 * | 5/2001 | F41A 19/31 | |
| WO | 8606825 A1 | 11/1986 | | |
| WO | 2013138918 A1 | 9/2013 | | |

OTHER PUBLICATIONS

Tonak. DE 20101250 U1. Machine Translation by <https://worldwide.espacenet.com>. May 10, 2001. (Year: 2001).*

* cited by examiner

TRIGGER MECHANISM FOR A FIREARM

CROSS-REFERENCE TO RELATED APPLICATION

This application is a divisional of U.S. patent application Ser. No. 17/515,009, filed on 29 Oct. 2021, now pending.

FIELD

The described examples relate generally to firearms. More particularly, the present examples relate to trigger mechanisms for firearms.

BACKGROUND

Whether hunting wild game, competing in competitive shooting events, or participating in recreational shooting with family and friends, firearms and the shooting sports incorporating firearms have been popular and prevalent in society for generations. There are many forms of firearms including handguns, rifles, shotguns, and so on. A firearm generally includes a barrel, a stock or grip, a trigger mechanism, and a firing mechanism (i.e., the action). The firearm can utilize a bolt action, a lever action, a pump action, an automatic action (e.g., semi-automatic or fully automatic), or another type of action. Each component of the firearm can impact or otherwise affect the overall accuracy, durability, safety, performance, and functionality of the firearm. Thus, improvements and innovations to the components of a firearm can be desirable to increase the efficacy of the firearm when utilized within shooting sports and other endeavors.

SUMMARY

According to some aspects of the present disclosure, a trigger mechanism can include a housing, a first sear, a second sear, a third sear, and a trigger. The second sear can be coupled to the first sear. The second sear can rotate relative to the housing. The third sear can be rotatably coupled to the housing. The third sear can form a surface that engages with a distal end of the second sear to prevent rotation of the second sear. The trigger can disengage the surface of the third sear from the distal end of the second sear when the trigger is rotated.

In some examples, the trigger mechanism can further include a sear linkage coupling the first sear to the second sear. The sear linkage can be rotatably coupled to the first sear by a first pin. The second sear can be rotatable relative to the housing about an axis. The sear linkage can be rotatably coupled to the second sear by a second pin. The second pin can be laterally offset from the axis. When the trigger is rotated, the surface of the third sear can transition relative to the distal end of the second sear a distance before disengaging from the distal end of the second sear. The surface of the third sear can transition relative to the distal end of the second sear before disengaging from the distal end of the second sear. For example, the first sear can include a distal end and a proximal end. The sear linkage can be coupled to the distal end of the first sear. The first sear can be rotatably coupled to the housing at the proximal end of the first sear. The first sear can be configured to retain a striker in a biased state while the surface of the third sear is engaged with the distal end of the second sear. The third sear can be biased to retain engagement between the surface of the third sear and the distal end of the second sear. A spring can contact the second sear and bias the second sear to rotate about a pin rotatably coupling the second sear to the housing.

According to another aspect of the present disclosure, a firearm can include a stock, a barrel, a receiver, a bolt assembly, and a trigger mechanism. The receiver can be configured to couple to the stock and the barrel. The bolt assembly can include a firing pin. The trigger mechanism can be disposed at least partially within the receiver. The trigger mechanism can include a housing, a first sear or striker sear, a second sear or main sear, a third sear or trigger sear, and a trigger. The second sear can be coupled to the first sear and rotatably coupled to the housing. The third sear can be rotatably coupled to the housing. The third sear can engage with the second sear to prevent rotation of the second sear. The third sear can disengage from the second sear to permit rotation of the second sear when the trigger is rotated.

In some examples, the firing pin can be biased to move toward the barrel. The first sear can prevent the firing pin from moving toward the barrel. The firing pin can exert a force on the first sear. The trigger mechanism can also include a sear linkage coupled to the first sear and the second sear. The force exerted on the first sear can at least partially transfer to the second sear through the sear linkage. At least a portion of the force exerted on the striker sear can be at least partially applied on the main sear through the sear linkage. The main sear can engage the trigger sear at a first end of the main sear. The sear linkage can be coupled to the main sear at a second end of the main sear. The trigger sear can be biased to engage the main sear. The trigger mechanism can also include a locking member that limits the firing pin from moving toward the barrel while the locking member is in a first position, and can enable the firing pin to move toward the barrel while the locking member is in a second position.

According to another aspect of the present disclosure, a trigger mechanism can include a housing, a sear, an actuator, a trigger, a first biasing member, and a second biasing member. The sear can be rotatably coupled to the housing. The actuator can be rotatably coupled to the housing. The actuator can engage with the sear to prevent rotation of the sear. The trigger can disengage the actuator from the sear when the trigger is rotated. Each of the first and second biasing members can bias the actuator to engage the sear.

In some examples, the first and second biasing members can be adjustable to vary a force required to rotate the trigger and disengage the actuator from the sear. The force can be greater than 1 pound in some examples. An amount of biasing force exerted on the actuator from the first biasing member can be adjustable by rotating a first fastener at least partially disposed within the housing. An amount of biasing force exerted on the actuator from the second biasing member can be adjustable by rotating a second fastener at least partially disposed within the housing. A biasing force generated by the first biasing member can be different from a biasing force generated by the second biasing member.

Features from any of the disclosed examples can be used in combination with one another, without limitation. In addition, other features and advantages of the present disclosure will become apparent to those of ordinary skill in the art through consideration of the following detailed description and the accompanying drawings. At least one of the biasing members can be a coiled spring. The housing can form a first aperture and the first biasing member can be at least partially disposed within the first aperture. The housing can form a second aperture and the second biasing member can be at least partially disposed within the second aperture.

At least one of the first biasing member or the second biasing member can be retained within the housing between a fastener and the actuator. The fastener can include an engagement structure forming a tamper proof interface.

BRIEF DESCRIPTION OF THE DRAWINGS

The drawings illustrate several examples of the present disclosure, wherein identical reference numerals refer to identical or similar elements or features in different views or examples shown in the drawings.

DETAILED DESCRIPTION

Figure 1A:
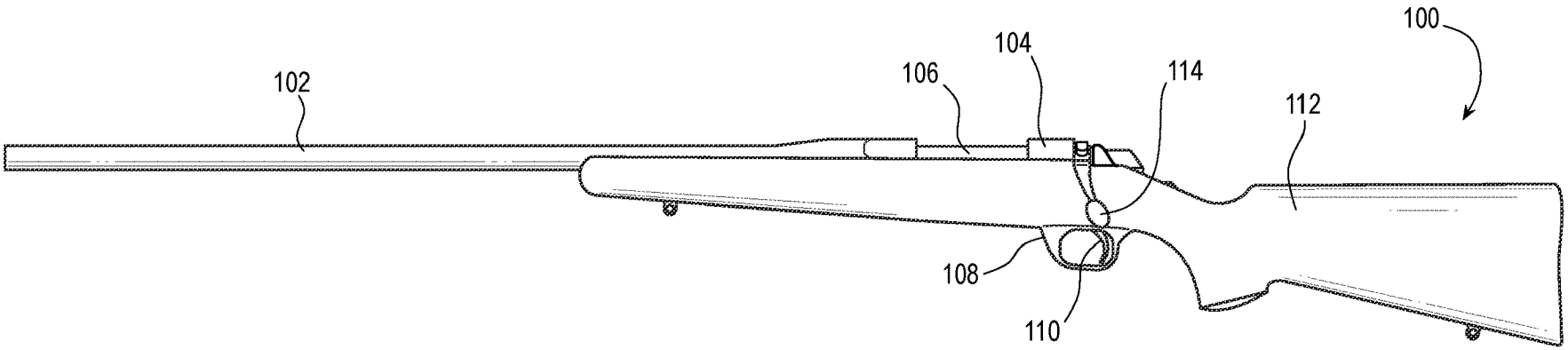
FIG. 1A is a side perspective view of a firearm.

The present description provides examples, and is not limiting of the scope, applicability, or configuration set forth in the claims. Thus, it will be understood that changes can be made in the function and arrangement of elements discussed, without departing from the spirit and scope of the disclosure, and various examples can omit, substitute, or add other procedures or components, as appropriate. Also, features described with respect to some examples can be combined in other examples.

A firearm can include a number of components and mechanisms which function in tandem to enable operation of the firearm. For example, a firearm can generally include one or more barrels, a stock or grip, a trigger mechanism, and a firing mechanism (i.e., the action). Efficient operation of each of these components can contribute to the overall performance of the firearm. The trigger mechanism can act as an interface between the shooter and the firearm. As such, characteristics of the trigger mechanism, such as trigger pull weight and the trigger pull travel, can directly correlate with the feel and performance of the firearm. A component of the trigger mechanism, such as a striker sear, can retain a firing pin or a striker of the firearm in a rearward position. Because the striker is biased to transition toward the firing chamber of the barrel, the striker can exert a force on the striker sear while the striker is in the rearward position. In some trigger mechanisms, this force can increase friction between components of the trigger mechanism, and thereby increase the pull weight of the trigger (i.e., increase the force required to pull the trigger to release the striker and discharge the firearm). Many shooters, however, desire a firearm having a reduced and/or adjustable trigger pull weight to customize the characteristics of their firearm and to optimize their performance.

The present disclosure relates to trigger mechanisms for firearms. In one aspect of the present disclosure, trigger mechanisms are described which utilize a linkage between a striker sear and a main sear to control an amount of force applied to the main sear by the striker sear. For example, a portion of the force exerted on the striker sear by the striker can be exerted on the main sear through a sear linkage. As described herein, the force applied on the striker sear by the striker and a ratio of moment arms defined by components within the trigger mechanism can correlate to a lesser force exerted on the trigger sear by a main sear. In other words, a force applied between the main sear and the trigger sear can amount to only a portion of the force exerted on the striker sear by the striker. Thus, frictional forces between the main sear and trigger sear of the trigger mechanism can be reduced to enable a relatively lesser trigger pull weight.

In another aspect of the present disclosure, trigger mechanisms are described which additionally, or alternatively, utilize one or more biasing members to provide a variable trigger pull weight. For example, one or more biasing members can engage an actuator or a trigger sear to apply resistance against rotation of the trigger sear when a trigger is pulled. The one or more biasing members can be compressed and/or decompressed to vary (e.g., increase or decrease) the amount of force required to rotate the trigger sear. A first biasing member can be set such that a minimum trigger pull weight is set and a second biasing member can be adjustable to increase or decrease the trigger pull weight to a value equal to or above the minimum trigger pull weight. This aspect will be described in greater detail below with reference to FIGS. 5A-6F.

These and other examples are discussed below with reference to FIGS. 1A-6F. However, those skilled in the art will readily appreciate that the detailed description given herein with respect to these Figures is for explanatory purposes only and should not be construed as limiting. While the present disclosure primarily references trigger mechanisms or systems which are disposed within a firearm, persons having skill in the art will readily appreciate that any of the aspects described herein can be applied to an after-market trigger mechanism that is designed for a specific firearm but sold separately from the firearm. Similarly, the present trigger mechanisms and configurations can be integral to a complete firearm, or can be included in a stand-alone drop-in trigger mechanism used in any number of firearm types and platforms.

FIG. 1A shows an example of a firearm 100 including a barrel 102 coupled to a receiver 104. The firearm 100 can also include a bolt 106 disposed within the receiver 104 and repositionable relative to the receiver 104. The firearm can include a trigger guard 108 and a trigger 110 at least partially positioned within the trigger guard 108. The trigger 110 can be a component of a trigger mechanism (see FIG. 3A)

coupled to the receiver 104 and/or the bolt 106 of the firearm 100. One or more of the barrel 102, the receiver 104, the bolt 106, and the trigger 110 can be at least partially disposed within a stock 112 of the firearm 100.

Figure 1B:
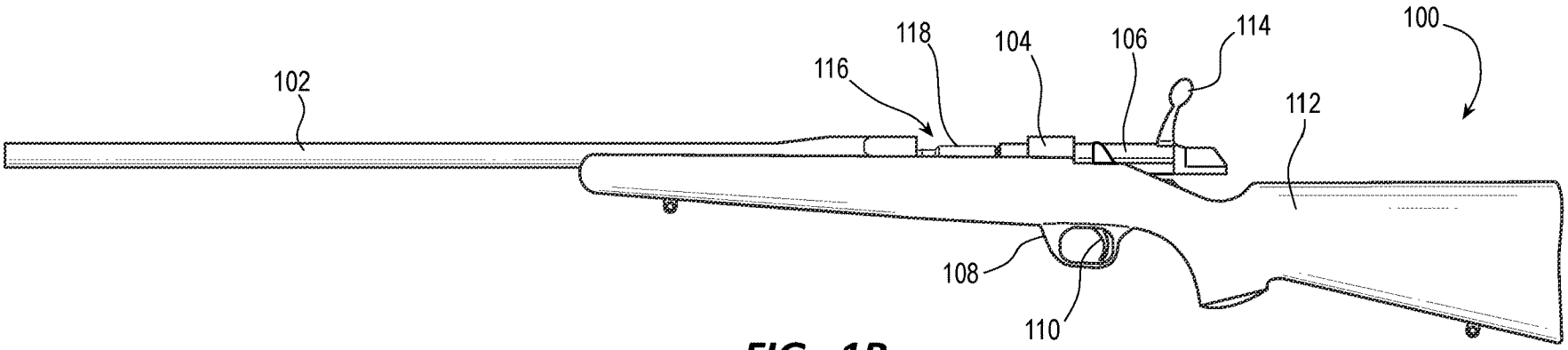
FIG. 1B is a side perspective view of the firearm of FIG. 1A having a bolt in a retracted position.

FIG. 1B shows the firearm 100 with the bolt 106 in a retracted or rearward position (i.e., slid rearward from the barrel 102). The bolt 106 can be retracted or slid rearward from the barrel 102 by rotating the bolt 106 using a bolt knob 114 affixed to the bolt 106. For example, the bolt knob 114 can be lifted from an initial position (shown in FIG. 1A) to rotate the bolt 106 and subsequently slid rearward from the barrel 102 to expose an ejection port 116 within the receiver 104. While the bolt 106 is in a retracted or rearward position, an ammunition cartridge 118 can be inserted into or ejected from the receiver 104. For example, the ammunition cartridge 118 can be a spent or discharged ammunition cartridge which is ejected from the receiver 104 when the bolt 106 is slid backward to the rearward position. While FIGS. 1A and 1B illustrate a bolt-action rifle, the present systems and methods can be incorporated into any type of firearm having any number of actuation types including, but in no way limited to, bolt-actions, break-actions, lever-actions, pump-actions, and/or semi-automatic action types.

Figure 2:
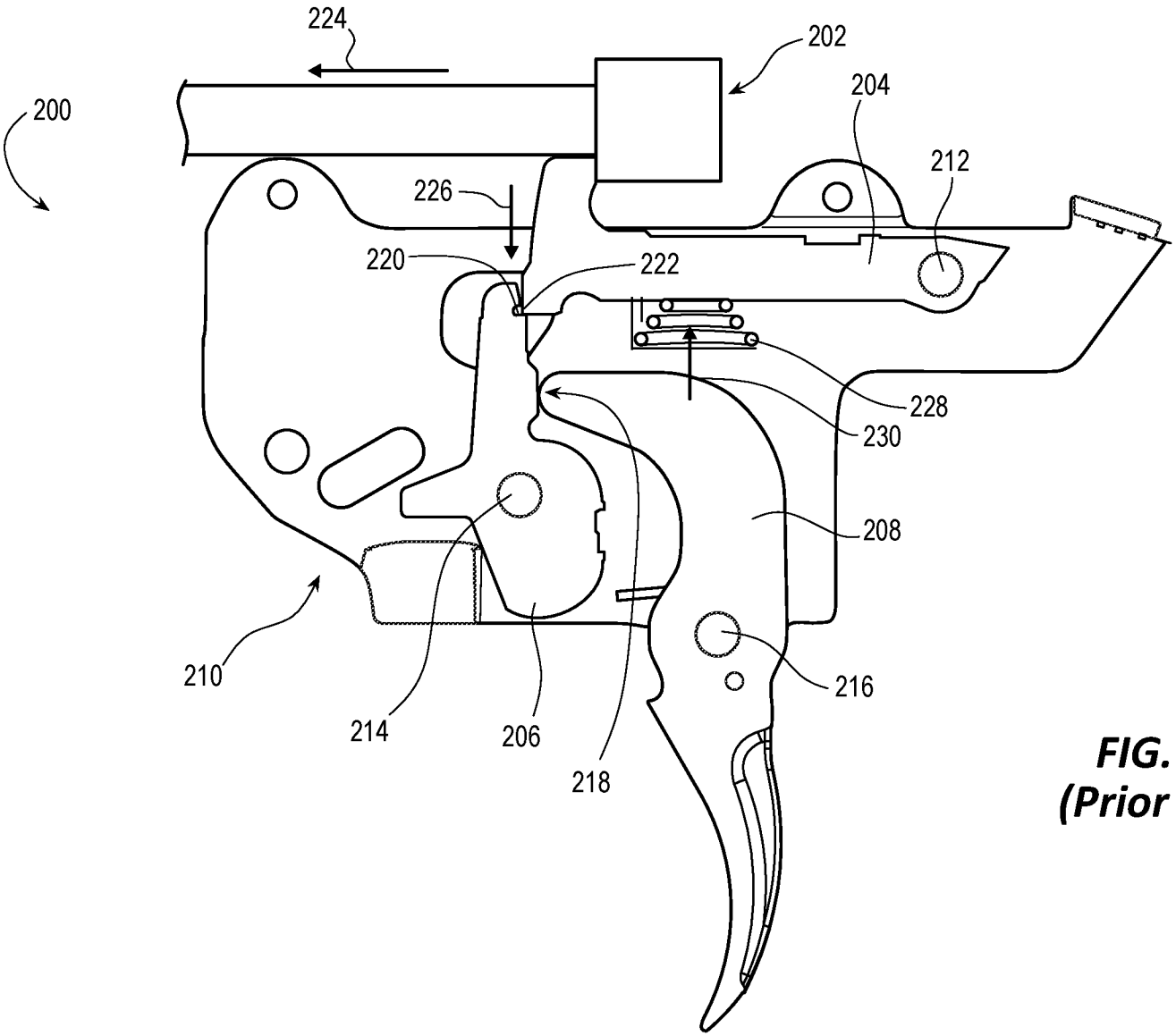
FIG. 2 (Prior Art)
FIG. 2 is a cross-sectional side view of a traditional trigger mechanism.

FIG. 2 shows a prior art trigger mechanism 200 and a striker 202. The trigger mechanism 200 can include a striker sear 204, a trigger sear 206, and a trigger 208 disposed within a housing 210. The striker sear 204, the trigger sear 206, and the trigger 208 can be rotatably coupled to the housing 210 by respective pins 212, 214, 216. When the trigger 208 is pulled (i.e., rotated about pin 216), a surface 218 of the trigger 208 can engage the trigger sear 206 to cause the trigger sear 206 to rotate about pin 214. When the trigger sear 206 rotates about the pin 214, a surface 220 of the trigger sear 206 can be pulled away from an engagement portion 222 of the striker sear 204 to allow the striker sear 204 to rotate about the pin 212 and subsequently release the striker 202 and discharge the firearm (i.e., cause the striker assembly to contact an ammunition cartridge disposed within a firing chamber of the barrel).

The striker sear 204 can engage the striker 202 to temporarily retain the striker 202 in a rearward position (i.e., displaced a distance from the barrel). The striker 202 can be biased to transition toward the barrel (not shown) as illustrated by a directional arrow 224. While the striker 202 is temporarily retained in the rearward position by the striker sear 204, the striker 202 can exert a force on the striker sear 204 which biases the striker sear 204 to rotate about pin 212. This force, (shown as arrow 226), can generate relatively large frictional forces between the surface 220 of the trigger sear 206 and the engagement portion 222 of the striker sear 204. The relatively large frictional forces can increase the associated pull weight of the trigger mechanism 200 (i.e., the force required to rotate the trigger about the pin 216 to discharge the firearm). In some examples, the trigger mechanism 200 can include a spring 228 which applies an opposing force (shown as arrow 230) on the striker sear 204 to counter some of the force exerted on the striker sear 204 by the striker 202.

In one aspect of the present disclosure, examples of trigger mechanisms are described which utilize a sear linkage to at least partially reduce the frictional forces induced on components of the trigger mechanism and thereby reduce a trigger pull weight associated with the trigger mechanism. The sear linkage can enable a portion of the force exerted on a striker sear by a striker to be carried by a housing of the trigger mechanism instead of being carried entirely by a main sear. Examples of trigger mechanisms having a sear linkage are described below with reference to FIGS. 3A and 3B.

Figure 3A:
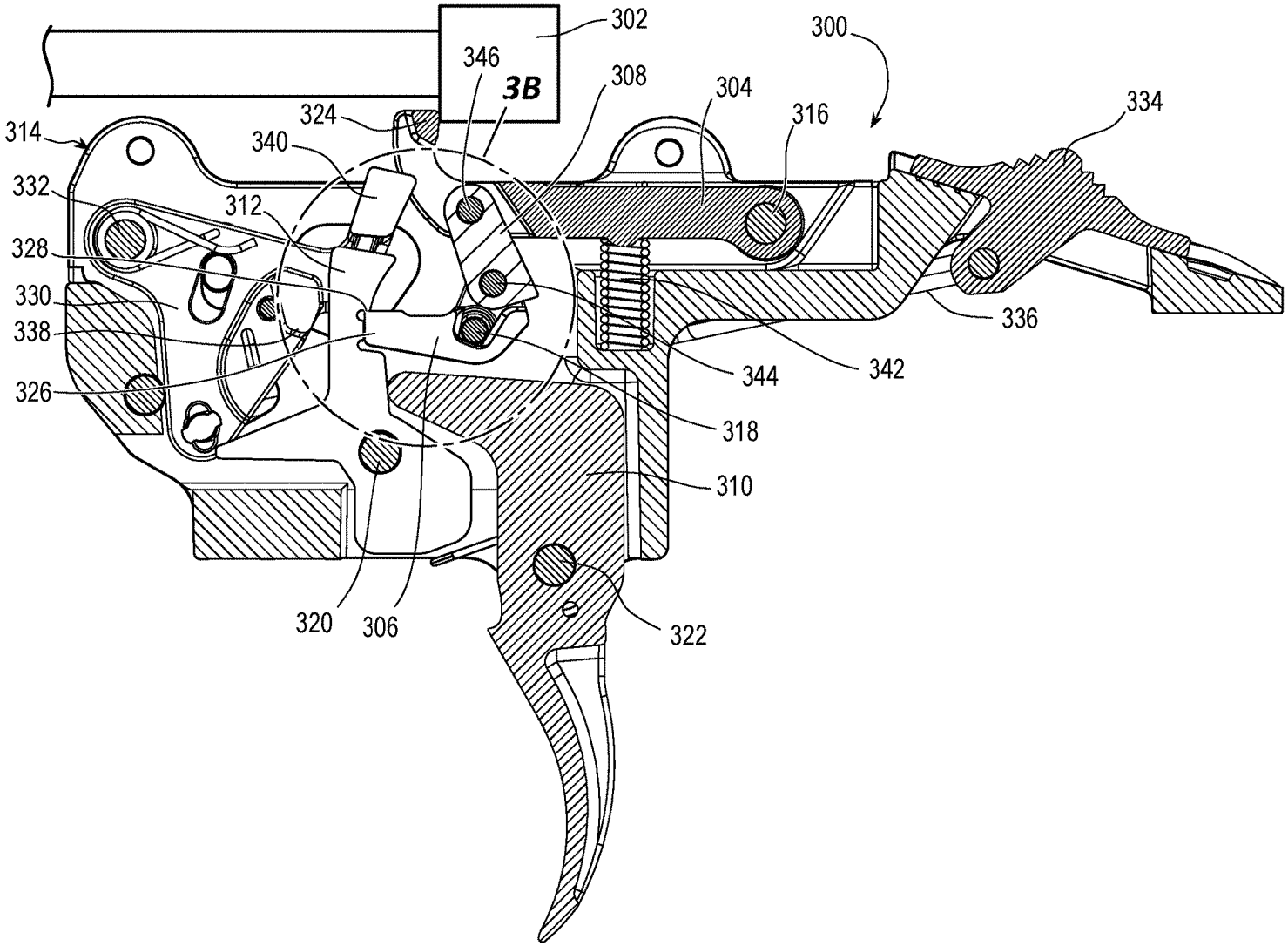
FIG. 3A is a side cross-sectional view of a trigger mechanism.

FIG. 3A shows a cross-sectional view of a trigger mechanism 300 and a firing pin or striker 302. The trigger mechanism 300 includes a striker sear 304 which engages the striker 302 to retain the striker 302 in a biased state (e.g., the striker 302 can be biased away from a barrel of a firearm such that the striker 302 can launch toward a firing chamber of the barrel when the striker sear 304 is disengaged from the striker 302). The striker sear 304 and a main sear 306 can be coupled by a sear linkage 308. The main sear 306 and a trigger 310 can engage with respective portions of a trigger sear 312. The striker sear 304, the main sear 306, the trigger sear 312, and the trigger 310 can each be rotatably coupled to a receiver or housing 314 by respective pins 316, 318, 320, 322. For example, the striker sear 304 can be rotatably coupled to the housing 314 by the pin 316 such that a distal end 324 of the striker sear 304 can move into and out of contact with the striker 302.

The main sear 306 can be rotatably coupled to the housing 314 by the pin 318, for example, the pin 318 can define an axis of rotation and the main sear 306 can rotate about the axis of rotation defined by the pin 318. A distal end 326 of the main sear 306 can engage with the trigger sear 312 to prevent the distal end 324 of the striker sear 304 from rotating away from the striker 302. The distal end 326 of the main sear 306 can be biased to engage with a planar surface 328 defined by the trigger sear 312. For example, a force generated by a biasing element (e.g., a spring) of the striker 302 can be exerted on the striker sear 304. The striker sear 304 can exert the force on the main sear 306 through the sear linkage 308. The force exerted on the main sear 306 by the striker 302 can bias the distal end 326 of the main sear 306 to engage with the trigger sear 312. However, as previously described, the force passed to the main sear 306 can generate relatively large frictional forces between the distal end 326 of the main sear 306 and the planar surface 328 of the trigger sear 312, and can thereby generate a relatively heavy trigger pull weight.

The trigger 310 can be rotatably coupled to the housing 314 by the pin 322 such that rotation of the trigger 310 causes rotation of the trigger sear 312 about the pin 320. For example, a user of the trigger mechanism 300 can rotate the trigger about the pin 322 using an index finger (i.e., the user can pull the trigger 310). Rotation of the trigger sear 312 about the pin 320 can cause the planar surface 328 of the trigger sear 312 to slide away from, or out of engagement with, the distal end 326 of the main sear 306. When the planar surface 328 is rotated out of engagement with the distal end 326 of the main sear 306, the main sear 306 can rotate about the pin 318 and enable the distal end 324 of the striker sear 304 to drop or otherwise disengage from the striker 302. While the striker sear 304 is no longer engaging the striker 302, the striker 302 can launch forward to contact an ammunition cartridge in the firing chamber of the firearm.

In some examples, the trigger mechanism 300 can also include a locking member 330 rotatably coupled to the housing 314 by a pin 332. The locking member 330 can be attached to a switch 334 by a rod 336. The switch 334 can be articulated by a user to transition the locking member 330 between a first position and a second position. While the locking member 330 is disposed in the first position (shown in FIG. 3A), the striker 302 can launch forward to contact the ammunition cartridge in the firing chamber of the firearm. When the locking member 330 is actuated or rotated via the switch 334 to the second position, the locking member 330 limits or prevents the trigger sear from rotating and the striker 302 from launching forward to contact the ammunition cartridge and prevents discharge of the firearm. In some examples, the locking member 330 can include a first catch block 338 which interfaces with the trigger sear 312 to prevent excessive rotation of the trigger sear 312 (i.e., rotation beyond the rotation necessary to disengage the trigger sear 312 from the main sear 306) while the locking member 330 is in the second position. Additionally, or alternatively, the locking member 330 can include a second catch block 340 disposed adjacent to the striker 302 when in the second position and limits or prevents the striker 302 from launching forward to contact the ammunition cartridge in the firing chamber of the firearm. By impeding or substantially impeding horizontal or forward travel of the striker 302, the second catch block 340 can immobilize the striker 302 to prevent unintentional discharge of the firearm.

In some examples, the trigger mechanism 300 can include a spring 342 which applies an opposing force on the striker sear 304 to at least partially counter a force exerted on the striker sear 304 by the striker 302. The functionality of the various components of the trigger mechanism 300 will be discussed in greater detail below with regard to FIG. 3B.

Figure 3B:
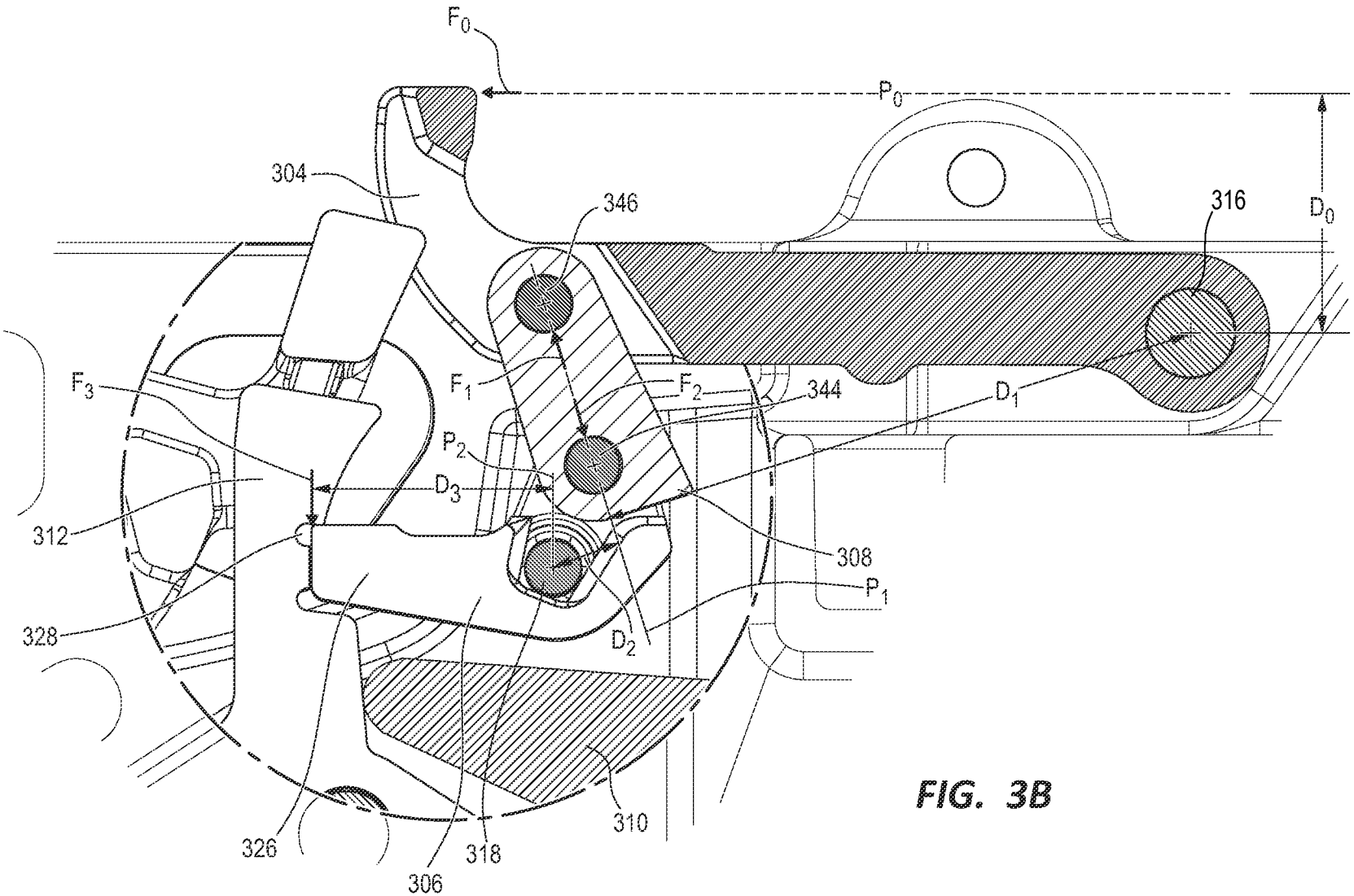
FIG. 3B is a detailed view of the trigger mechanism of FIG. 3A.

FIG. 3B shows a detailed view of the trigger mechanism 300 shown in FIG. 3A. The striker 302 can exert a force $F_0$ on the striker sear 304 (e.g., a force applied by a spring affixed to the striker 302 which biases the striker 302 toward the barrel). The sear linkage 308 can be pivotably coupled to the main sear 306 by a pin 344. The sear linkage 308 can be pivotably coupled to the striker sear 304 by a pin 346. The force $F_0$ exerted on the striker sear 304 and a moment arm or distance $D_0$ between a line of action defined by the force $F_0$ and the pin 316 can define a first moment. At least a portion of the force $F_0$ exerted on the striker sear 304 can be applied to the sear linkage 308 because the striker sear 304 is coupled to the sear linkage 308, for example, via the pin 346. In order for the sear linkage 308 to remain in a fixed or static position relative to the striker sear 304 and the main sear 306 while the force $F_0$ is applied to the sear linkage 308, a reaction force $F_1$ can be exerted on the striker sear 304. The force $F_1$ can be equal to and opposing the portion of the force $F_0$ applied by the striker sear 304 onto the sear linkage 308. The force $F_1$ exerted on the sear linkage 308 by the striker sear 304 and a moment arm or distance $D_1$ between a line of action defined by the force $F_1$ and the pin 316 can define a second moment.

The portion of the force $F_0$ exerted on the striker sear 304 can be transferred through the sear linkage 308 and applied to the main sear 306, shown as force $F_2$. The force $F_1$ and the force $F_2$ can be equivalent or substantially equivalent. The force $F_2$ can be exerted on the main sear 306 because the sear linkage 308 is coupled to the main sear 306, for example, via the pin 344. The force $F_2$ exerted on the main sear 306 and a moment arm or distance $D_2$ between a line of action defined by the force $F_2$ and the pin 318 can define a third moment. In order for the main sear 306 to remain in a fixed or static position relative to the sear linkage 308 and the trigger sear 312 while the force $F_2$ is applied to the main sear 306, a force $F_3$ can be exerted on the distal end 326 of the main sear 306. The force $F_3$ exerted on the distal end 326 of the main sear 306 and a moment arm or distance $D_3$ between a line of action defined by the force $F_3$ and the pin 318 can define a fourth moment. A magnitude of the force $F_3$ can correlate to the force $F_0$ exerted on the striker sear 304 and the respective distances $D_0$, $D_1$, $D_2$, and $D_3$. For example, the distance $D_3$ can be greater than the distance $D_2$ such that the force $F_3$ applied to the distal end 326 of the main sear 306 is less than the force $F_2$ exerted on the main sear 306 by the striker sear 304 through the sear linkage 308. This lesser force $F_3$ (e.g., lesser than the force $F_2$) can correlate to a lighter trigger pull weight due to the lesser force $F_3$ applying relatively lesser frictional forces between the distal end 326 of the main sear 306 and the planar surface 328 of the trigger sear 312.

In some examples, a reference plane $P_0$ can be drawn in line with the force $F_0$ (e.g., the line of action of $F_0$). The reference plane $P_0$ can extend generally parallel to the main sear 306 while the distal end 326 of the main sear 306 is engaging with the planar surface 328 of the trigger sear 312. The pin 316 can be positioned at an offset or distance relative to the plane $P_0$. For example, the pin 316 can be offset the distance $D_0$ from the plane $P_0$. The distance $D_0$ can be at least about 1 millimeters (mm), between about 1 mm and about 3 mm, between about 3 mm and about 6 mm, between about 6 mm and about 15 mm, or less than about 20 mm.

In some examples, a reference plane $P_1$ can be drawn in line with the forces $F_1$, $F_2$ (e.g., the line of action) and through the respective pins 344, 346 coupling the sear linkage 308 to the main sear 306 and the striker sear 304, as shown in FIG. 3B. The reference plane $P_1$ can extend generally perpendicular to the distal end of the main sear 306 while the distal end 326 of the main sear 306 is engaging with the planar surface 328 of the trigger sear 312. The pin 316 can be positioned at an offset or distanced relative to the plane $P_1$. For example, the pin 316 can be offset the distance $D_1$ from the plane $P_1$. The distance $D_1$ can be at least about 5 millimeters (mm), between about 5 mm and about 10 mm, between about 10 mm and about 15 mm, between about 15 mm and about 30 mm, or less than about 30 mm. The pin 344 can be laterally offset or distanced from the pin 316 which defines the axis of rotation of the main sear 306. The pin 318 can be positioned at an offset or distanced relative to the plane $P_1$. For example, the pin 318 can be offset the distance $D_2$ from the plane $P_1$. The distance $D_2$ can be at least about 0.5 millimeters (mm), between about 0.5 mm and about 1 mm, between about 1 mm and about 3 mm, between about 3 mm and about 6 mm, or less than about 6 mm.

In some examples, a reference plane $P_2$ can be drawn through the pin 318 coupling the main sear 306 to the housing 314. The reference plane $P_2$ can extend perpendicular to the planar surface 328 of the trigger sear 312. The distal end 326 of the main sear 306 can engage the planar surface 328 of the trigger sear 312 on a first side of the reference plane $P_2$. The pin 344 can be coupled to the main sear 306 on a second side of the reference plane $P_2$. In some examples, the distal end 326 of the main sear 306 can engage the planar surface 328 of the trigger sear 312 at the distance $D_3$ from the plane $P_2$. The distance $D_3$ can be at least about 5 millimeters (mm), between about 5 mm and about 10 mm, between about 10 mm and about 15 mm, between about 15 mm and about 20 mm, or less than about 20 mm.

As shown in Equations 1~4 below, the respective forces $F_0$, $F_1$, $F_2$ and their moment arms or distances $D_0$, $D_1$, $D_2$, along with the moment arm or distance $D_3$, can correlate to the force $F_3$ exerted on the distal end 326 of the main sear 306. For example, the distance $D_2$ and the distance $D_3$ can form a ratio, such as, a ratio of 0.176 wherein the distance $D_2$ is 1.5 mm and the distance $D_3$ is 8.5 mm (e.g., 1.5 mm/8.5 mm=0.176). The ratio can be at least about 0.05, between about 0.05 and about 0.1, between about 0.1 and about 0.5, between about 0.5 and about 0.7, or less than about 1. In other words, the force $F_0$ and the distances $D_0$, $D_1$, $D_2$, $D_3$ can be selected (i.e., the trigger mechanism 300 can be designed and manufactured) such that the force $F_3$ does not generate undesirable frictional forces between the planar surface 328 of the trigger sear 312 and the distal end 326 of the main sear 306.

$$F_0 * D_0 = F_1 * D_1 \quad \text{(Equation 1)}$$

$$F_1 = \frac{F_0 * D_0}{D_1} \quad \text{(Equation 2)}$$

$$F_1 = F_2 \quad \text{(Equation 2.5)}$$

$$F_2 * D_2 = F_3 * D_3 \quad \text{(Equation 3)}$$

$$F_3 = \frac{F_0 * D_0}{D_1} * \frac{D_2}{D_3} = \frac{F_0 * D_0 * D_2}{D_1 * D_3} \quad \text{(Equation 4)}$$

In some examples, the force $F_0$ and the distances $D_0$, $D_1$, $D_2$, $D_3$ can be selected such that the force $F_3$ does not exceed a desired maximum threshold or fall below a desired minimum threshold. For example, the force $F_3$ can be at least about 1 lb, between about 1 lb and about 2 lbs, between about 2 lbs and about 3 lbs, between about 3 lbs and about 5 lbs, or less than about 5 lbs.

In some examples, the trigger mechanism 300 may not include a sear linkage 308. Instead, the striker sear 304 can be directly coupled to the main sear 306. For example, a portion of the striker sear 304 can form a slot and the main sear 306 can be pinned or coupled to the slot such that the main sear 306 can rotate and translate (e.g., at least two degrees of freedom) relative to the striker sear 304. While the reference plane $P_1$ is depicted as partially vertical in FIG. 3B, the trigger mechanism 300 can be rotated or modified, such that the reference plane $P_1$ can be more or less horizontal.

Figure 4A:
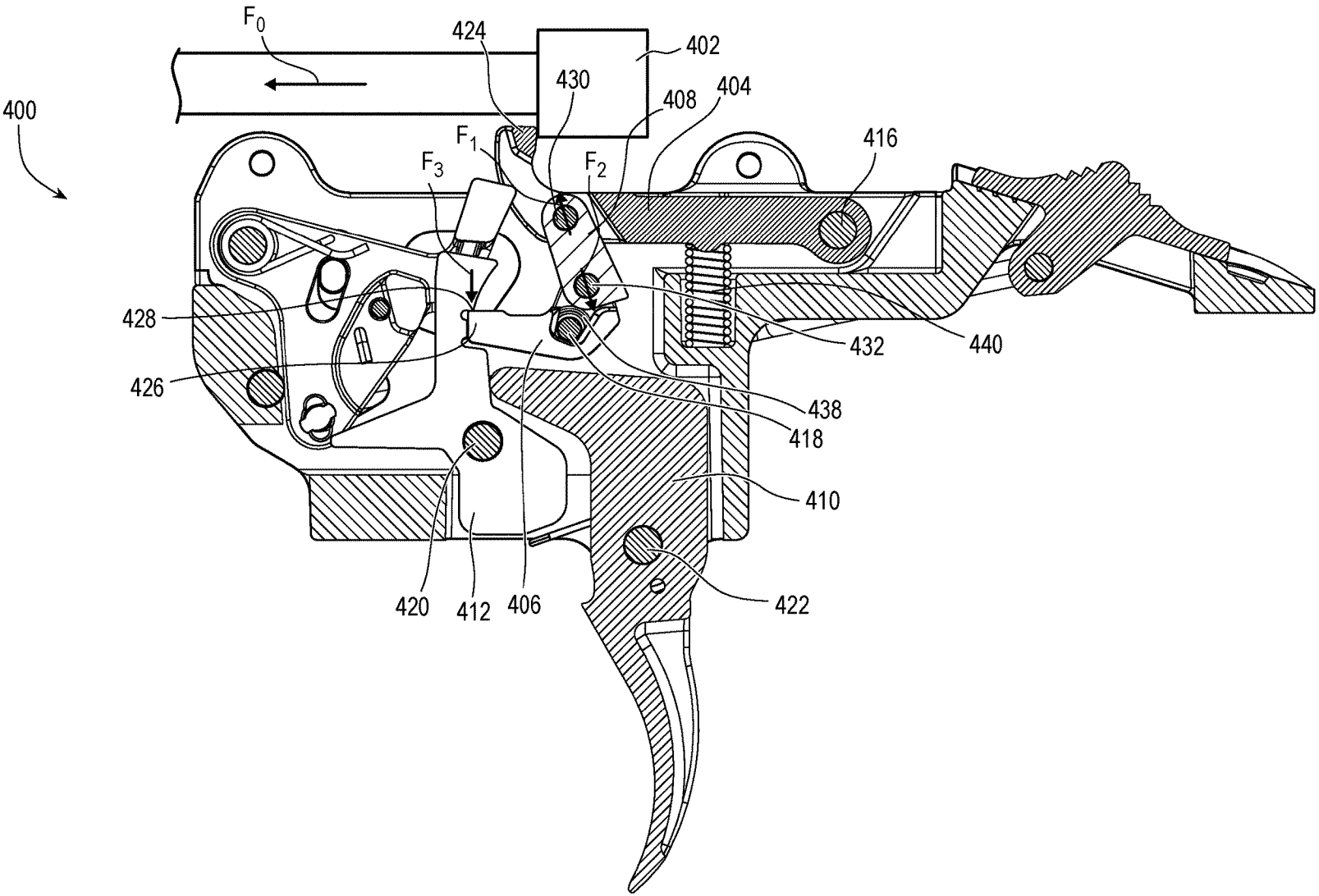
FIG. 4A is a cross-sectional side view of a trigger mechanism in a first configuration.

FIG. 4A shows a cross-sectional side view of a trigger mechanism 400 in a first configuration. In the first configuration, the trigger mechanism 400 can be in an unfired configuration in which a striker 402 is retained by the trigger mechanism 400 in a biased state. The trigger mechanism 400 can include a striker sear 404 which engages the striker 402 to retain the striker 402 in the biased state (e.g., the striker sear 404 can inhibit the striker 402 from launching toward a firing chamber of the barrel). The striker sear 404 and a main sear 406 can be coupled by a sear linkage 408. The main sear 406 and a trigger 410 can engage with respective portions of a trigger sear 412. The striker sear 404, the main sear 406, the trigger sear 412, and the trigger 410 can each be rotatably coupled to a receiver or housing 414 by respective pins 416, 418, 420, 422.

The striker sear 404 can be substantially similar to, and can include some or all of the features of, the striker sear 304. For example, the striker sear 404 can be rotatably coupled to the housing 414 by the pin 416 such that a distal end 424 of the striker sear 404 can move into and out of contact with the striker 402. The main sear 406 can be substantially similar to, and can include some or all of the features of, the main sear 306. For example, the main sear 406 can include a distal end 426 which interfaces with a planar surface 428 formed on the trigger sear 412 to inhibit rotation of the main sear 406. The sear linkage 408 can be substantially similar to, and can include some or all of the features of, the sear linkage 308. For example, the sear linkage 408 can couple or interconnect the striker sear 404 and the main sear 406 while still enabling the striker sear 404 and the main sear 406 to rotate about respective pins 416, 418. The trigger 410 can be substantially similar to, and can include some or all of the features of, the trigger 310. For example, a user of the trigger mechanism 400 can rotate the trigger 410 about the pin 422 using an index finger (i.e., the user can pull the trigger 410) such that the trigger 410 engages with the trigger sear 412. The trigger sear 412 can be substantially similar to, and can include some or all of the features of, the trigger sear 312. For example, the trigger sear 412 can define the planar surface 428 which engages with the distal end 426 of the main sear 406.

In some examples, the firing pin or striker 402 can be biased toward the barrel of the firearm. For example, the striker 402 can include or otherwise be coupled to a spring which biases the striker toward the barrel of the firearm. In the first configuration, the trigger mechanism 400 can retain the striker 402 in a position that is displaced from the barrel. For example, the distal end 424 of the striker sear 404 can be positioned adjacent the striker 402 as to contact or otherwise engage with the striker 402 to prevent the striker 402 from traveling toward the barrel. While displaced from the barrel, the spring or other biasing member can generate a force $F_0$. The striker 402 can exert the force $F_0$ on the distal end 424 of the striker sear 404. At least a portion of the force $F_0$ can be transferred through the sear linkage 408 to the main sear 406 to apply a force $F_2$. The sear linkage 408 can be pivotably coupled to the striker sear 404 by a pin 430, and can be pivotably coupled to the main sear 406 by a pin 432.

At least a portion of the force $F_2$ can be exerted on the main sear 406 biasing the main sear 406 to rotate about the pin 418. The force $F_2$ can be less than the force $F_0$. At least a portion of the force $F_2$ can bias the main sear 406 to rotate about the pin 418. While the force $F_2$ biases the main sear 406 to rotate about the pin 418, the planar surface 428 of the trigger sear 412 can exert a force $F_3$ on the distal end 426 of the main sear 406. A magnitude or value of the force $F_3$ can vary relative to the respective forces $F_0$, $F_1$, $F_2$ and their moment arms or distances (e.g., distances $D_0$, $D_1$, $D_2$, along with the moment arm or distance $D_3$ shown in FIG. 4B). For example, the force $F_3$ can correlate to a ratio including the distances $D_0$, $D_1$, $D_2$ $D_3$ and the force $F_0$, as shown in Equation 4. The ratio can be at least about 0.05, between about 0.05 and about 0.1, between about 0.1 and about 0.5, between about 0.5 and about 0.7, or less than about 1.

Figure 4B:
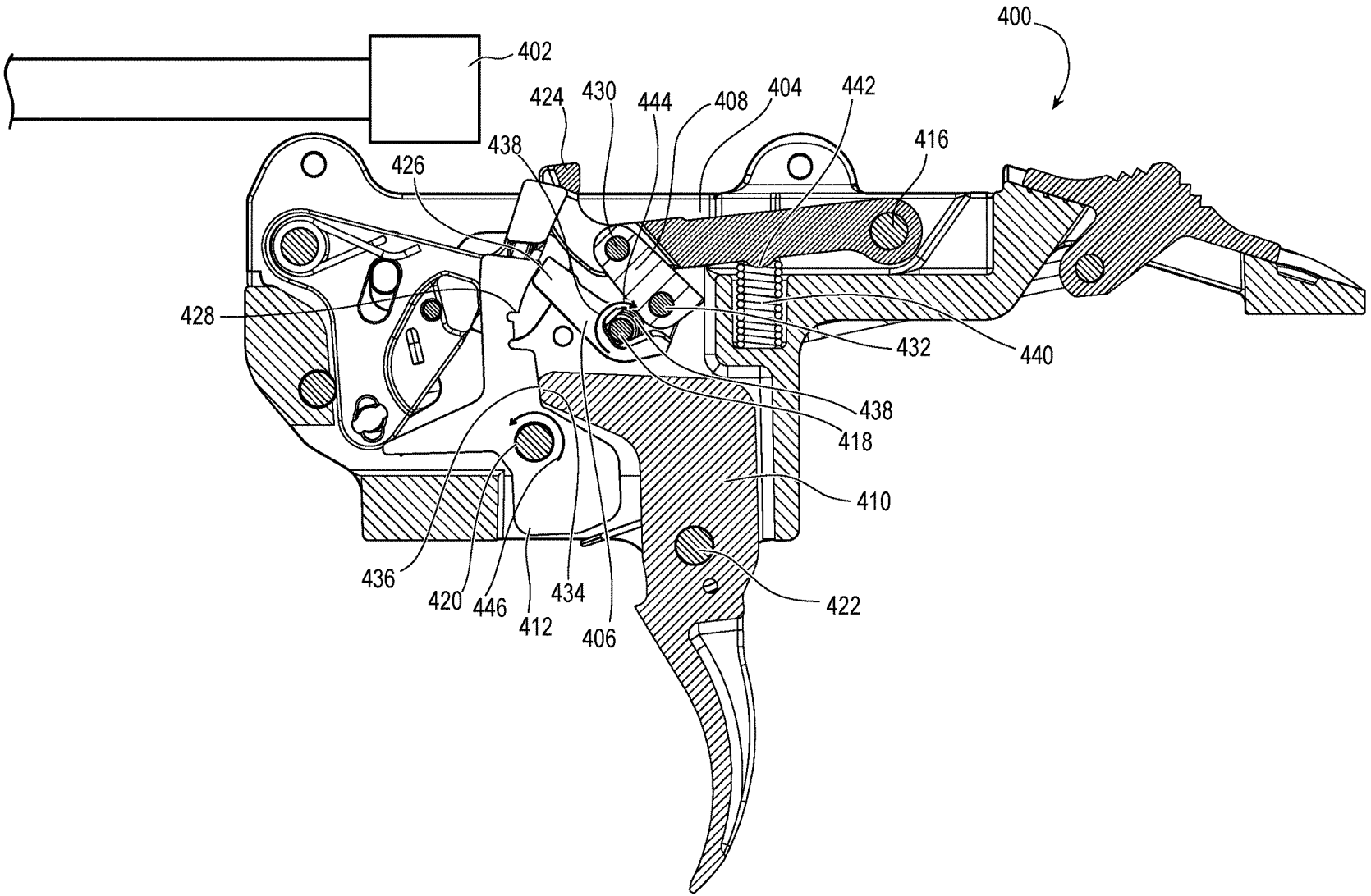
FIG. 4B is a cross-sectional side view of a trigger mechanism in a second configuration.

FIG. 4B shows a cross-sectional side view of the trigger mechanism 400 in a second configuration. In the second configuration, the trigger mechanism 400 can be in a post-fired or post-actuated configuration in which the striker 402 has been released by the trigger mechanism 400 from the biased state shown in FIG. 4A. For example, when a user pulls the trigger 410 (e.g., exerts a force on the trigger 410 causing the trigger 410 to rotate about the pin 422), a portion 434 of the trigger 410 can engage a surface 436 of the trigger sear 412 to cause the trigger sear 412 to rotate about the pin 420 (as indicated by the rotational arrow 446 adjacent to the pin 420). Rotation of the trigger sear 412 about the pin 420 can pull or draw the planar surface 428 away from or out of contact with the distal end 426 of the main sear 406 such that the distal end 426 of the main sear 406 rotates toward the striker sear 404. In some examples, the main sear 406 can be biased to rotate about the pin 418 by a spring 438 disposed around the pin 418 and contacting the main sear 406. For example, the spring 438 can bias the main sear 406 to rotate about the pin 418 such that the main sear 406 is biased to return to an unfired position. In other words, the spring 438 can apply a biasing force on the main sear 406 which causes the main sear 406 to rotate back to the first configuration shown in FIG. 4A wherein the distal end 426 of the main sear 406 is positioned to engage the planar surface 428 of the trigger sear 412.

In some examples, the trigger sear 412 is rotated such that the planar surface 428 releases the main sear 406 to enable the main sear 406 to rotate about the pin 418 (as indicated by the rotational arrow 444 adjacent the pin 418). Rotation of the main sear 406 about the pin 418 can enable the sear linkage 408 to pivot relative to pins 430, 432, and thereby release the distal end 424 of the striker sear 404 from engagement with the striker 402. The striker sear 404 can be at least partially biased to engage the striker 402 by a spring 440. For example, the spring 440 can interface with a protrusion 442 on the striker sear 404 and bias the striker sear 404 toward the striker 402. The striker 402 can be driven by a spring or other biasing element (not shown) toward the barrel of the firearm when the striker sear 404 is disengaged from the striker 402.

In another aspect of the present disclosure, trigger mechanisms are described which additionally, or alternatively, utilize one or more biasing members to provide a variable trigger pull weight. For example, one or more biasing members can engage a trigger sear, a trigger, another component, or a combination thereof to apply a force in resistance to its rotation when a trigger is pulled. In some examples, the one or more biasing members can be compressible and/or decompressible to vary (e.g., increase or decrease) the amount of force required to rotate the trigger sear and/or trigger. A first biasing member can be set such that a minimum pull weight is set and a second biasing member can be adjustable to increase or decrease the trigger pull weight to a value at or above the minimum pull weight set by the first biasing member. This aspect will be described in greater detail below with reference to FIGS. 5A-6B.

Figure 5A:
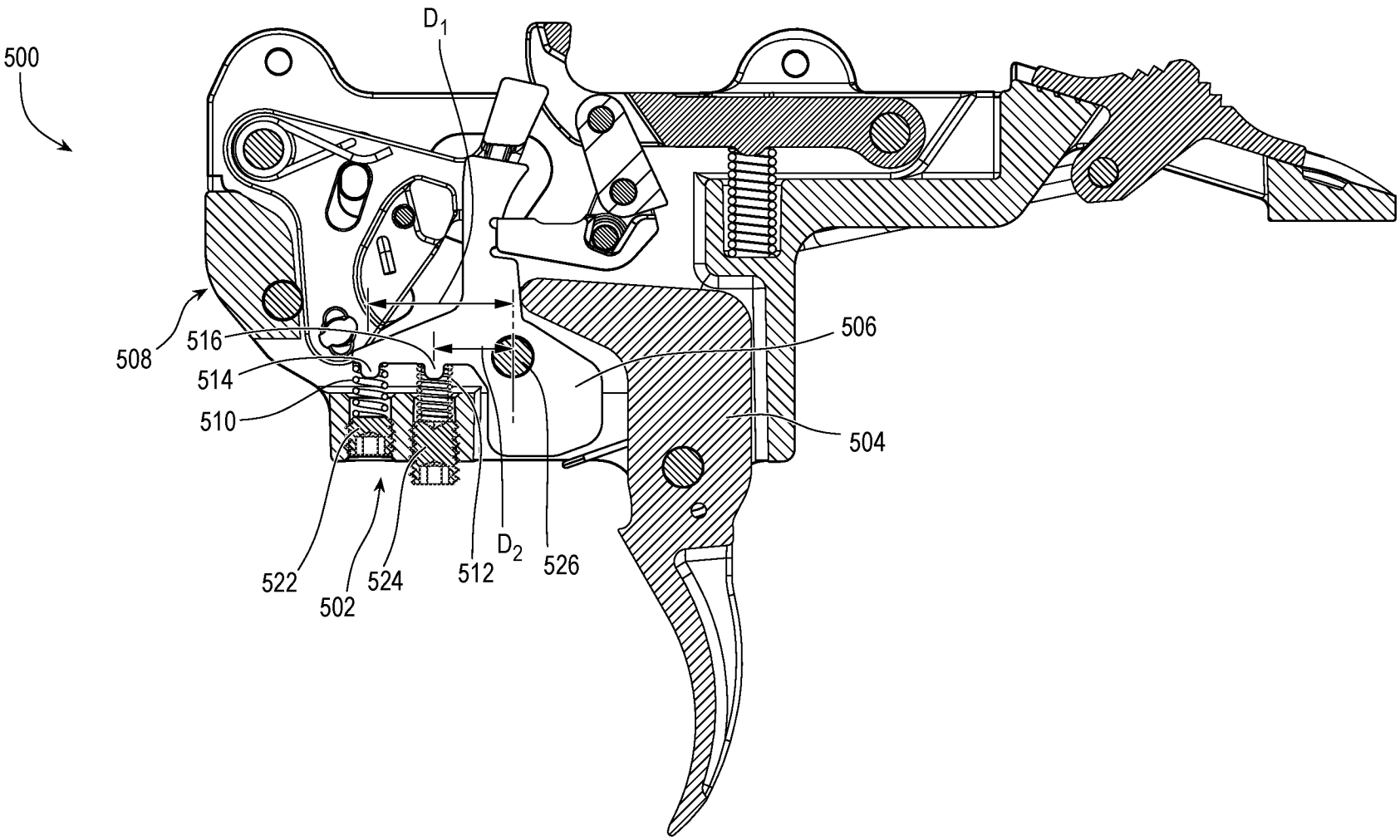
FIG. 5A is a cross-sectional side view of a biasing mechanism for a trigger mechanism.
Figure 5B:
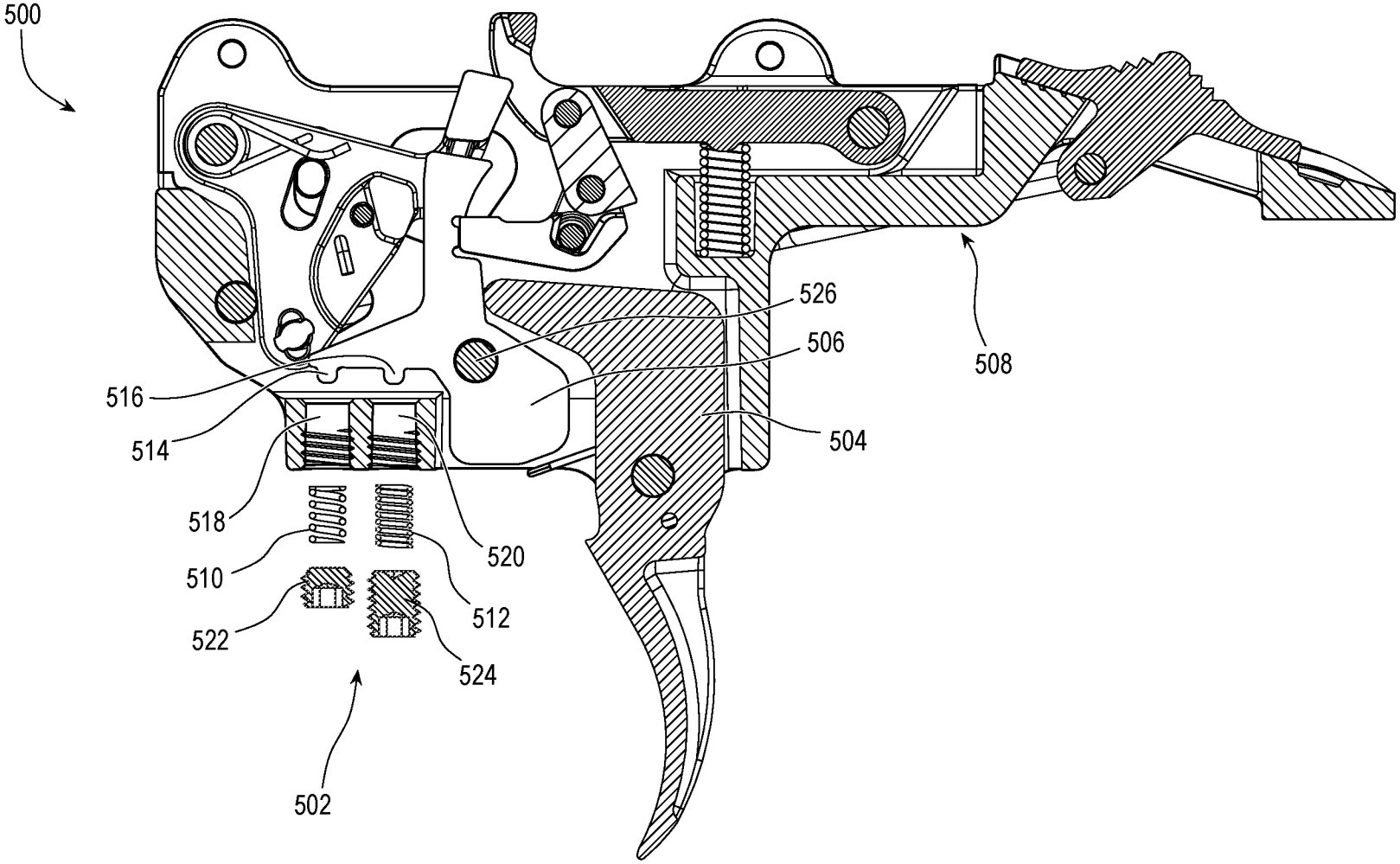
FIG. 5B is a partially exploded cross-sectional side view of the biasing mechanism for the trigger mechanism of FIG. 5A.

FIGS. 5A and 5B show a trigger mechanism 500 including a biasing mechanism 502, a trigger 504, and a trigger sear 506. In some examples, at least one component of the trigger mechanism 500 can be at least partially disposed within a housing 508. The housing 508 can be configured to be releasably retained within a receiver of a firearm (e.g., the receiver 104 of the firearm 100). For example, the housing 508 can be fastened, clipped, pinned, or otherwise coupled within the receiver of the firearm. The biasing mechanism 502 can vary the amount of force required to pull the trigger 504 by biasing the trigger sear 506 to resist rotation when the trigger 504 is pulled. For example, the biasing mechanism 502 can include a first biasing member 510 and a second biasing member 512 which engage the trigger sear 506.

In some examples, the first biasing member 510 can contact a first protrusion 514 extending from the trigger sear 506. The second biasing member 512 can contact a second protrusion 516 extending from the trigger sear 506. The first and second biasing members 510, 512 can be disposed within respective recesses 518, 520 formed by the housing 508. In examples, the first biasing member 510 can be disposed within the recess 518 and between the first protrusion 514 of the trigger sear 506 and a first fastener 522. Similarly, the second biasing member 512 can be disposed within the recess 520 and between the second protrusion 516 of the trigger sear 506 and a second fastener 524. The first and second fasteners 522, 524 can be threadably received within the first and second recesses 518, 520, of the housing 508, respectively, such that each of the first and second fasteners 522, 524 can be repositionable within the respective recesses 518, 520 relative to the trigger sear 506. For example, the first fastener 522 and/or the second fastener 524 can be rotated to travel toward or away from the trigger sear 506, thereby compressing or decompressing the first biasing member 510 and/or second biasing member 512, respectively. Compressing or decompressing one of the first or second biasing members 510, 512 can increase or decrease the force applied on the trigger sear 506 by the first or second biasing member 510, 512 and thereby vary a force required by a user to pull the trigger 504 (i.e., the trigger pull weight).

One or both of the first and second biasing members 510, 512 can be a spring, such as, a coiled spring which engages the trigger sear 506. The first biasing member 510 can have a spring constant greater than, less than, or equivalent to a spring constant of the second biasing member 512. In some examples, the spring constant of the first biasing member 510 can be larger than the spring constant of the second biasing member 512 such that the first biasing member 510 is stiffer than the second biasing member 512. Accordingly, in these examples, the first biasing member 510 can apply a greater force on the trigger sear 506 as the first fastener 522 is rotated to move toward the trigger sear 506 than the force applied on the trigger sear 506 by the second biasing member 512 as the second fastener 524 is rotated to move toward the trigger sear 506. In some examples, the spring constant of the second biasing member 512 can be larger than the spring constant of the first biasing member 510 such that the second biasing member 512 is stiffer than the first biasing member 510. Accordingly, in these examples, the second biasing member 512 can apply a greater force on the trigger sear 506 as the second fastener 524 is rotated to move toward the trigger sear 506 than the force applied on the trigger sear 506 by the first biasing member 510 as the first fastener 522 is rotated to move toward the trigger sear 506.

The trigger sear 506 can rotate about a pin 526 coupled to the housing 508. The first biasing member 510 can contact the trigger sear 506 at a distance $D_1$ from the pin 526. The second biasing member 512 can contact the trigger sear 506 at a distance $D_2$ from the pin 526. In some examples, the first protrusion 514 can engage the first biasing member 510 to cause the first biasing member 510 to contact the trigger sear 506 at the distance $D_1$. In some examples, the second protrusion 516 can engage the second biasing member 512 to cause the second biasing member 512 to contact the trigger sear 506 at the distance $D_2$. The distance $D_1$ can be greater than the distance $D_2$, for example, the distance $D_1$ can be at or between about 1.5 and about 3 times greater than the distance $D_2$.

Figure 5C:
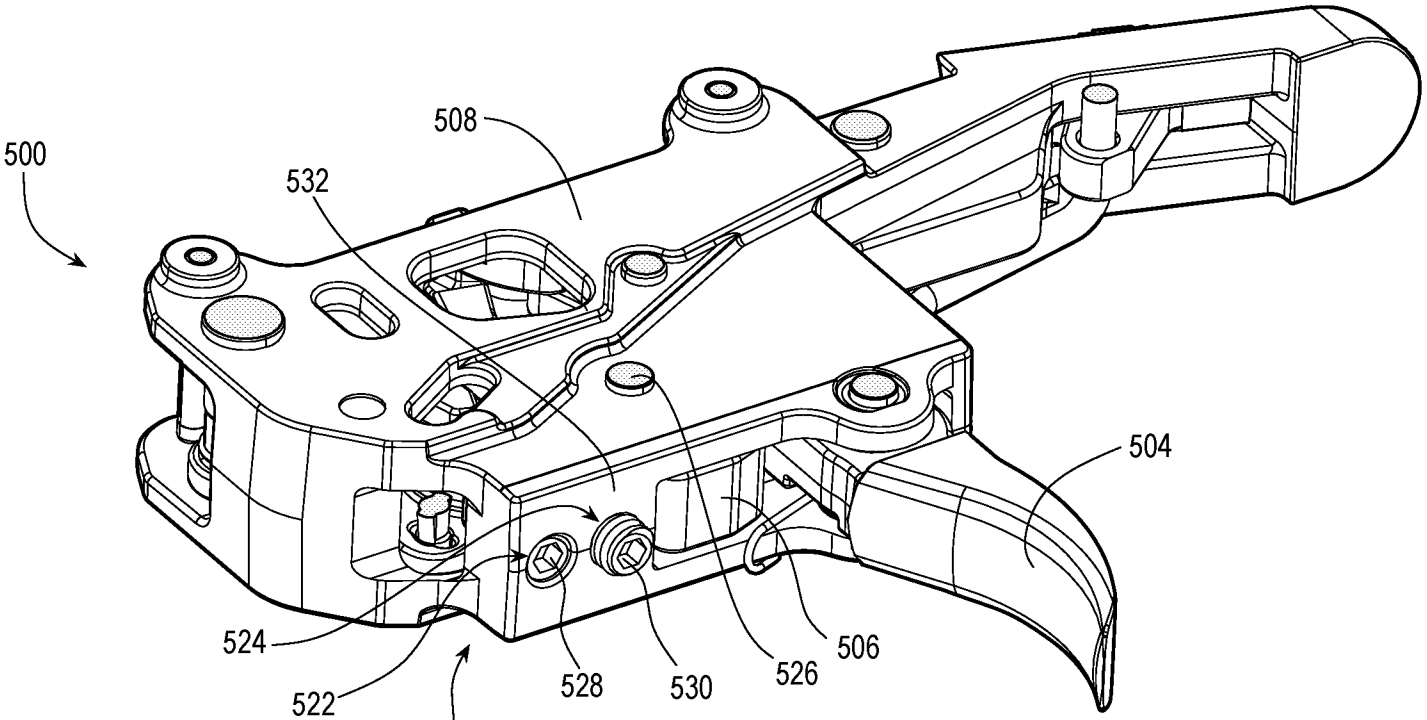
FIG. 5C is a bottom perspective view of the biasing mechanism of FIG. 5A.

FIG. 5C shows a bottom perspective view of the biasing mechanism 502 of the trigger mechanism 500. The first fastener 522 can include an engagement structure 528, such as, a recess defining a particular shape configured to engage a tool (not shown) to enable a user to rotate the first fastener 522 relative to the housing 508 (e.g., toward and away from the trigger sear 506). The second fastener 524 can include an engagement structure 530, such as, a recess defining a particular shape configured to engage a tool (not shown) to enable a user to rotate the second fastener 524 relative to the housing 508 (e.g., toward and away from the trigger sear 506). For example, one or both of the engagement structures 528, 530 can be shaped to receive a portion of a tool, such as, a wrench, a screwdriver, and/or another tool. In some examples, at least one of the engagement structures 528, 530 can define a hexagonal shaped recess configured to receive an Allen wrench or another tool having a hexagonal shaped tool head. While FIG. 5C depicts engagement structures 528, 530 defining hexagonal shaped recesses, the shape and profile of each engagement structure 528, 530 can define any shape, profile, or form that interfaces or otherwise engages with a tool.

The first fastener 522 and/or the second fastener 524 can at least partially extend from an exterior surface 532 of the housing 508, or otherwise be accessible through the housing 508, to enable rotation of the first fastener 522 and/or second fastener 524 without deconstructing the trigger mechanism 500 (e.g., removing a portion of the housing 508). In some examples, at least one of the engagement structures 528, 530 can be accessible by a tool while the trigger mechanism 500 is disposed within the receiver (e.g., receiver 104) such that the user is not required to remove the trigger mechanism 500 from the firearm to rotate the first and/or second fasteners 522, 524. In some examples, at least one of the engagement structures 528, 530 can be accessible only while the trigger mechanism 500 is removed from the receiver (e.g., receiver 104). For example, at least one of the engagement structures 528, 530 can be covered or hidden by another component of the firearm, such as, a stock, a trigger guard, a decal, a combination thereof, or another component of the firearm.

Figure 5D:
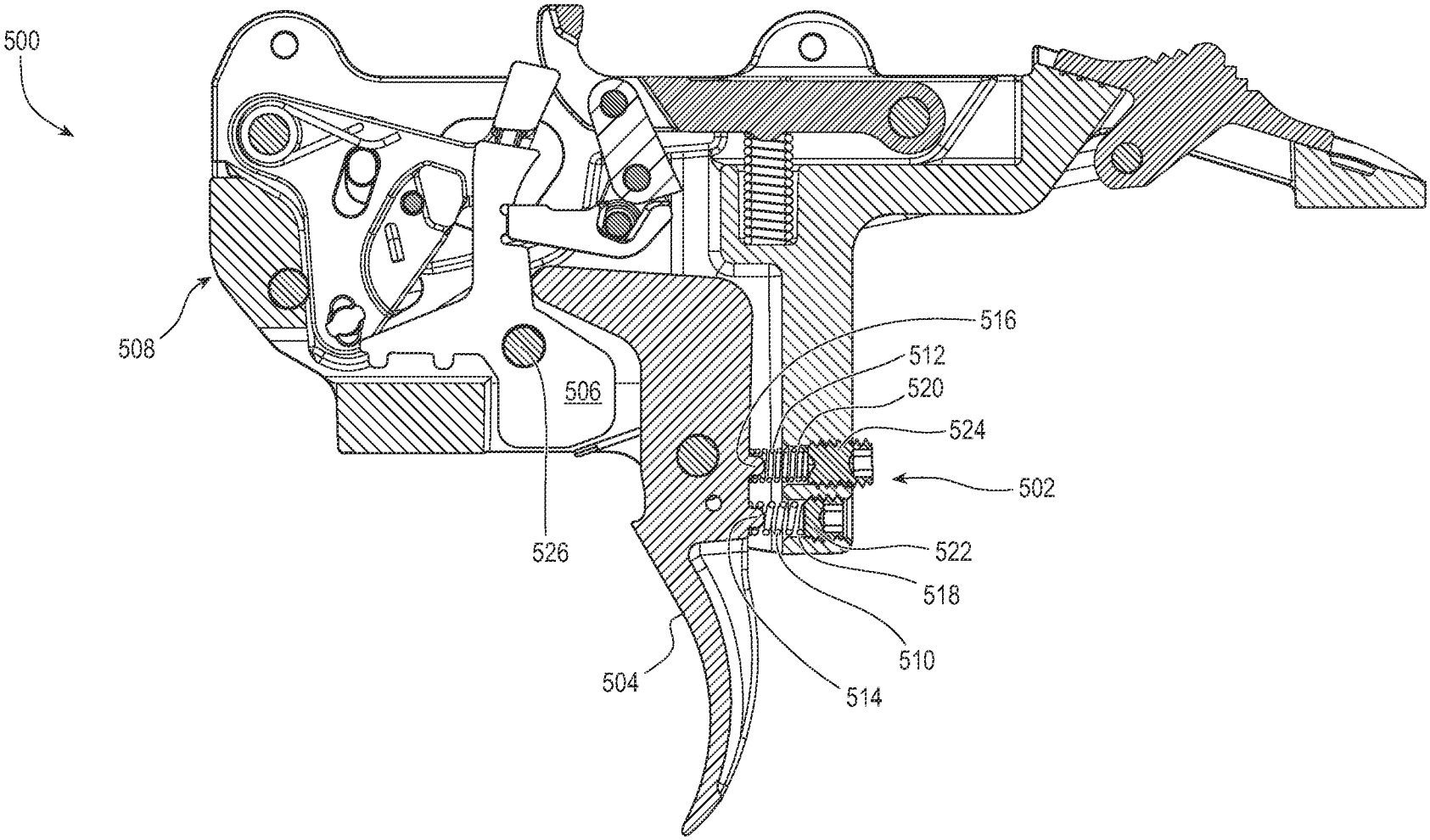
FIG. 5D is a cross-sectional side view of another example of a biasing mechanism for a trigger mechanism.

FIG. 5D shows an example having the biasing mechanism 502 disposed at a different location or position on the housing 508. In this example, the biasing mechanism 502 can vary the amount of force required to pull the trigger 504 by biasing the trigger 504 to resist rotation when the trigger 504 is pulled. For example, the first biasing member 510 and the second biasing member 512 can exert a force on the trigger 504 which can be modified by rotating the first and/or second fasteners. The examples shown in FIGS. 5A-5C and 5D are merely two example applications of many application in which the biasing mechanism 502 exerts a force on the trigger mechanism 500. In some examples, the biasing mechanism 502 can engage or otherwise bias other components or multiple components of the trigger system 500. For example, one example (not shown) can include a first biasing mechanism applied as shown in FIG. 5A and a second biasing mechanism applied as shown in FIG. 5D. Additionally, or alternatively, the biasing mechanism 500 can have more or fewer biasing members than the first and second biasing members 510, 512 shown in FIGS. 5A-5D.

In some examples, the first biasing member 510 can contact a first protrusion 514 extending from the trigger 504. The second biasing member 512 can contact a second protrusion 516 extending from the trigger 504. The first and second biasing members 510, 512 can be disposed within respective recesses 518, 520 formed by the housing 508. In examples, the first biasing member 510 can be disposed within the recess 518 and between the first protrusion 514 of the trigger 504 and the first fastener 522. Similarly, the second biasing member 512 can be disposed within the recess 520 and between the second protrusion 516 of the trigger 504 and the second fastener 524. The first and second fasteners 522, 524 can be threadably received within the first and second recesses 518, 520, of the housing 508, respectively, such that each of the first and second fasteners 522, 524 can be repositionable within the respective recesses 518, 520 relative to the trigger 504. For example, the first fastener 522 and/or the second fastener 524 can be rotated to travel toward or away from the trigger 504, thereby compressing or decompressing the first biasing member 510 and/or second biasing member 512, respectively. Compressing or decompressing one of the first or second biasing members 510, 512 can increase or decrease the force applied on the trigger 504 by the first or second biasing member 510, 512 and thereby vary a force required by a user to pull the trigger 504 (i.e., the trigger pull weight).

One or both of the first and second biasing members 510, 512 can be a spring, such as, a coiled spring which engages the trigger 504. The first biasing member 510 can have a spring constant greater than, less than, or equivalent to a spring constant of the second biasing member 512. In some examples, the spring constant of the first biasing member 510 can be larger than the spring constant of the second biasing member 512 such that the first biasing member 510 is stiffer than the second biasing member 512. Accordingly, in these examples, the first biasing member 510 can apply a greater force on the trigger 504 as the first fastener 522 is rotated to move toward the trigger 504 than the force applied on the trigger 504 by the second biasing member 512 as the second fastener 524 is rotated to move toward the trigger 504. In some examples, the spring constant of the second biasing member 512 can be larger than the spring constant of the first biasing member 510 such that the second biasing member 512 is stiffer than the first biasing member 510. Accordingly, in these examples, the second biasing member 512 can apply a greater force on the trigger 504 as the second fastener 524 is rotated to move toward the trigger 504 than the force applied on the trigger 504 by the first biasing member 510 as the first fastener 522 is rotated to move toward the trigger 504.

Figure 6B:
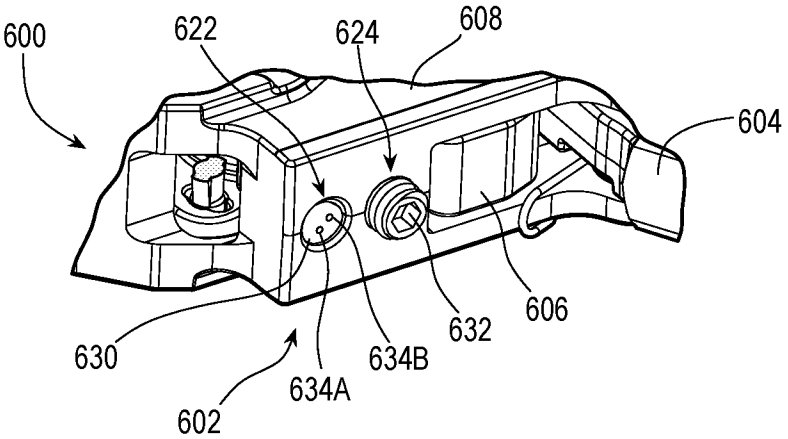
FIG. 6B is a bottom perspective view of a biasing mechanism for a trigger mechanism.
Figure 6A:
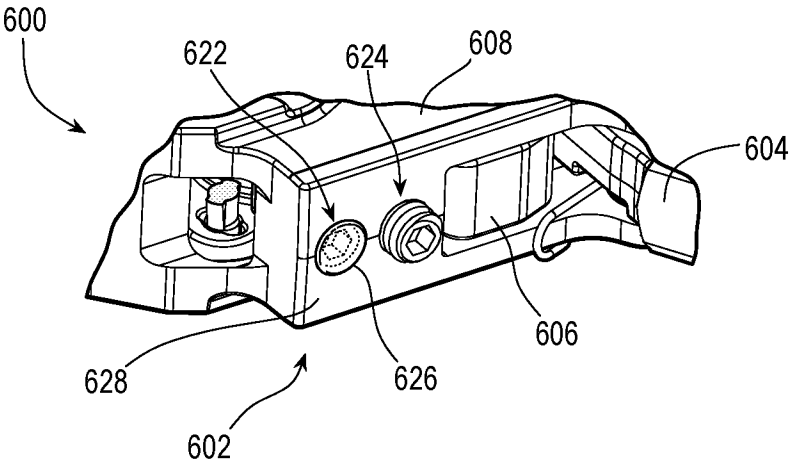
FIG. 6A is a bottom perspective view of a biasing mechanism for a trigger mechanism.

FIGS. 6A-6F show partial bottom views of a trigger mechanism 600 including examples of fasteners having various engagement structures. FIG. 6A shows the trigger mechanism 600 including a biasing mechanism 602, a trigger 604, and a trigger sear 606. In examples, at least one component of the trigger mechanism 600 can be at least partially disposed within a housing 608. The housing 608 can be configured to be coupled to or at least partially disposed within a receiver of a firearm (e.g., the receiver 104 of the firearm 100). For example, at least a portion of the housing 608 can be fastened, clipped, pinned, or otherwise coupled to the receiver of the firearm. The biasing mechanism 602 can be substantially similar to, and can include some or all of the features of, the biasing mechanism 502. For example, the biasing mechanism 602 can vary the amount of force required to pull the trigger 604 by biasing the trigger sear 606 to resist rotation when the trigger 604 is pulled. The biasing mechanism 602 can include a first biasing member (e.g., the biasing member 510) and a second biasing member (e.g., the biasing member 512) which engage the trigger sear 606. The first and second biasing members (not shown) can be retained within respective apertures or recesses (e.g., recesses 518, 520) formed within the housing 608. The first and second biasing members can be retained within the apertures or recesses by first and second fasteners 622, 624, respectively.

The biasing mechanism 602 can set a pull weight of the trigger 604 to a particular value within a range of values. Furthermore, the biasing mechanism 602 can set a minimum trigger pull weight (i.e., a lowest amount of force required to pull the trigger) within the range of values. A manufacturer of firearms, for example, can desire to set the minimum trigger pull weight value at the factory before shipping the firearm to a distributor or consumer.

In some examples, a manufacturer of firearms or trigger mechanisms can remove the second fastener 624 or otherwise rotate the second fastener 624 such that the second biasing member is no longer exerting a force on the trigger sear 606. Thereafter, the manufacturer can rotate (e.g., clockwise or counterclockwise) the first fastener 622 until a desired minimum force required to pull the trigger 604 is set (i.e., the first biasing member can apply a force on the trigger sear 606 that requires a desired minimum trigger pull weight at the trigger 604 before the trigger sear 606 will disengage from the main sear). The first fastener 622 can then be obstructed or rendered inaccessible such that subsequent persons are prevented from rotating the first fastener 622 to vary the desired minimum force set by the manufacturer. Accordingly, because the second fastener 624 is rotated such that the second biasing member is not applying a force on the trigger sear 606 before the first fastener 622 is set, subsequent rotation of the second fastener 624 may only increase the amount of force required to pull the trigger 604, not decrease the amount of force required to pull the trigger 604. In other words, the force applied on the trigger sear 606 by the first biasing member can act as a base line or minimum value for the trigger pull weight and subsequent force placed on the trigger sear 606 by the second biasing member can only increase the trigger pull weight from the baseline or minimum value.

While the minimum trigger pull weight is described as being set by the first fastener 622 herein, the second fastener 624 can alternatively be utilized to set the minimum trigger pull weight of the trigger mechanism 600. For example, the manufacturer can remove the first fastener 622 or otherwise rotate the first fastener 622 such that the first biasing member is no longer exerting any force on the trigger sear 606, and thereafter, the manufacturer can rotate (e.g., clockwise or counterclockwise) the second fastener 624 until the desired minimum force required to pull the trigger 604 is set. Thereafter, the manufacturer can obstruct or render the second fastener 624 inaccessible to prevent future adjustment of the second fastener 624 and the resultant minimum value set by the manufacturer.

The biasing mechanism 602 can include one or more components or features which prevent or inhibit adjustment of the first fastener 622 after the minimum trigger pull weight value is set. For example, as shown in FIG. 6A, the first fastener 622 can be subsequently covered by a cap 626 (illustrated as transparent in FIG. 6A). The cap 626 can be disposed within a recess (e.g., recess 518) defined by the housing 608 to cover or otherwise obstruct access to the first fastener 622. The cap 626 can be affixed within the recess by an interference fit, an adhesive, a threaded connection, a magnetic connection, another coupling mechanism, or a combination thereof. The cap 626 can be manufactured from a metal, a polymer, a ceramic, or a combination thereof. In examples, the cap 626 can be flush with an exterior surface 628 of the housing 608.

The first fastener 622 and/or second fastener 624 of the biasing mechanism 602 can include respective engagement structures 630, 632 which prevent or inhibit adjustment of the first fastener 622 and/or the second fastener 624 without a particular tool. In other words, one or both of the first and second fasteners 622, 624 can include engagement structures 630, 632 that define tamper proof interfaces. For example, as shown in FIG. 6B, the first fastener 622 can include an engagement structure 630 which necessitates a tool having a security head having multiple prongs to engage first and second blind holes 634A, 634B defined by the engagement structure 630 to rotate the first fastener 622. The security head required to rotate the first fastener 622 can be uncommon and thereby limit or inhibit a user from rotating the first fastener 622 after a desired minimum trigger pull weight is set. Additionally, or alternatively, the second fastener 624 can include an engagement structure 632 which necessitates a tool having a security head to rotate the second fastener 624. The security head required to rotate the second fastener 624 can be uncommon and thereby limit or inhibit a user from rotating the second fastener 624 after a desired minimum trigger pull weight is set.

While the engagement structure 630 defines first and second blind holes 634A, 634B, any known or subsequently discovered security interface pattern can be defined by the engagement structure 630. For example, the engagement structure 630 and/or engagement structure 632 can define a torx style recess, a clutch style recess, a fluted socket style recess, a tri-wing recess, a square recess, a 5 or 7 node security recess, a hexagonal recess, a spanner drilled recess, a spanner slotted recess, a combination thereof, or any other security type recess. Furthermore, the engagement structure 630 can define a pillar or central column commonly formed within tamper proof bolt heads.

Figure 6D:
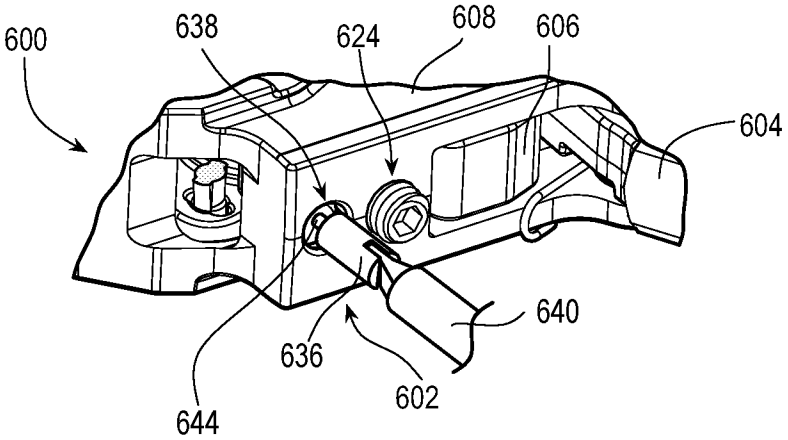
FIG. 6D is a bottom perspective view of a trigger mechanism.
Figure 6C:
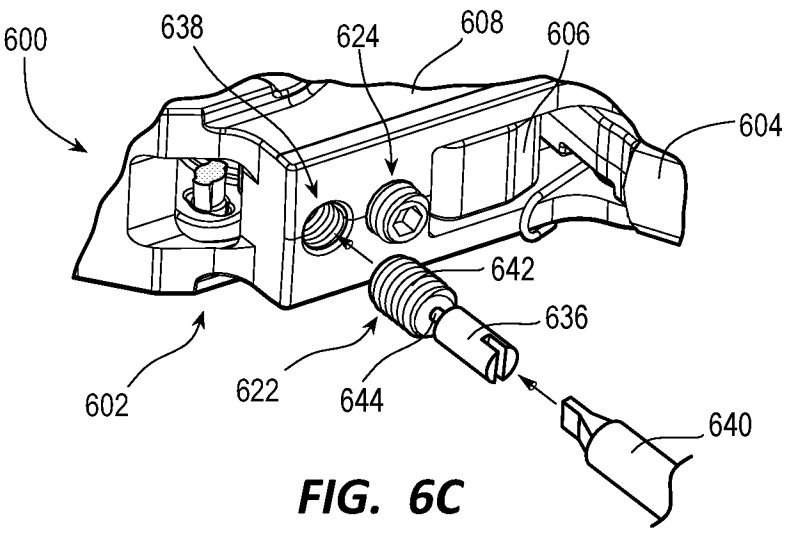
FIG. 6C is a bottom perspective view of a trigger mechanism.

FIGS. 6C-6F show another example of the trigger mechanism 600 including a first fastener 622 having a removable portion 636. As shown in FIGS. 6C and 6D, a manufacturer can insert the first fastener 622 into a threaded recess 638 using a tool 640 or other object to rotate the first fastener 622 within the recess 638 to a desired position within the recess 638 (i.e., setting or establishing the minimum trigger pull weight of the trigger mechanism 600 as described herein). While a flat head screwdriver and a correlating slot on the removable portion 636 are shown in FIGS. 6C and 6D, any other type of tool and correlating interface can be employed. Additionally, or alternatively, a thumb and a finger can be engaged on the removal portion 636 to rotate the first fastener 622 into or out of the recess 638.

Figure 6F:
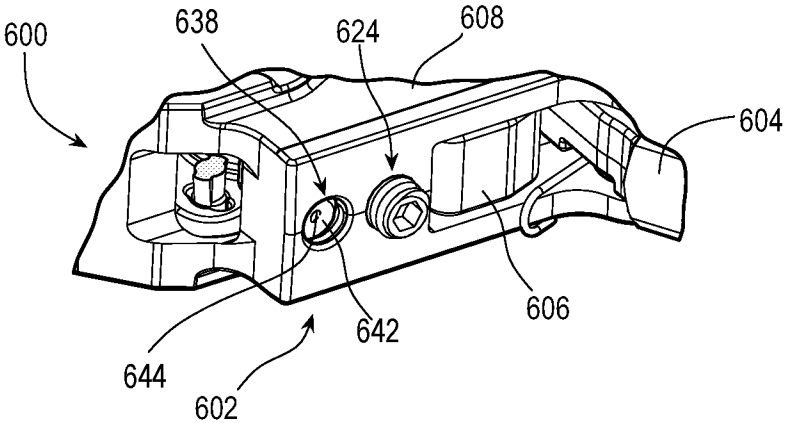
FIG. 6F is a bottom perspective view of a trigger mechanism.
Figure 6E:
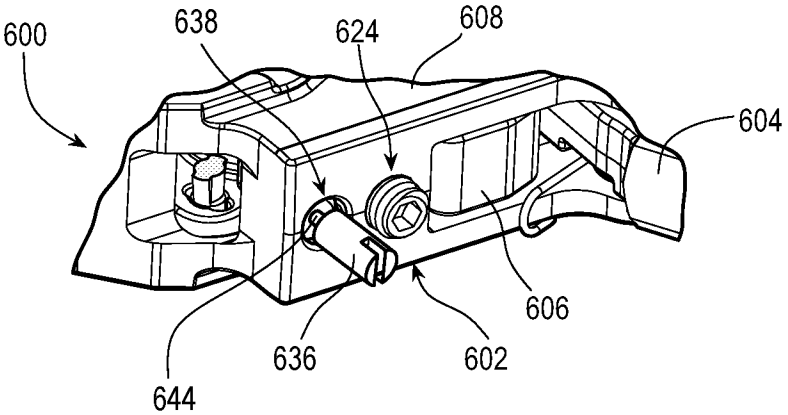
FIG. 6E is a bottom perspective view of a trigger mechanism.

As shown in FIGS. 6E and 6F, after the first fastener 622 has been disposed at the desired position within the recess 638, the removable portion 636 of the first fastener 622 can be removed or broken away from the first fastener 622 to prevent subsequent persons from altering the position of the first fastener 622 and thereby manipulating the baseline or minimum trigger pull weight set by the manufacturer. In some examples, the removable portion 636 can be retained to a body 642 of the first fastener 622 by a thinned section 644. The thinned section 644 can be cracked, cut, or broken to enable separation of the removable portion 636 from the body 642 of the first fastener 622.

In some examples, the endpoint values disclosed herein may be approximate values, which may vary by 10% or less from the precise endpoint value given. In such examples, the term "about" or "substantially" may indicate the approximate values.

Aspects of any of the examples disclosed herein may be used with aspects of any other examples, disclosed herein without limitation.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A trigger mechanism, comprising:

a housing;

a first sear rotatably coupled to the housing;

a second sear rotatably coupled to the housing, the second sear engageable with the first sear to prevent rotation of the first sear;

a trigger configured to disengage the second sear from the first sear when the trigger is rotated;

a third sear rotatably coupled to the housing;

a striker translatable towards and away from a firearm barrel, wherein the third sear is engageable with the striker;

a first adjustable biasing member engageable with a contact area on one of the trigger or the second sear to provide a first amount of rotational resistance corresponding to a baseline trigger pull weight; and a second adjustable biasing member engageable with a same one of the trigger or the second sear at the contact area to provide a second amount of rotational resistance corresponding to additional trigger pull weight.

2. The trigger mechanism of claim 1, wherein the baseline trigger pull weight and the additional trigger pull weight compose a total trigger pull weight.

3. The trigger mechanism of claim 1, wherein the first biasing member and the second biasing member are engageable with the second sear.

4. The trigger mechanism of claim 1, further comprising a first surface protrusion and a second surface protrusion positioned on one of the trigger or the second sear, wherein:

the first biasing member is engageable with the first surface protrusion; and the second biasing member is engageable with the second surface protrusion.

5. The trigger mechanism of claim 4, wherein:

the second sear is rotatably coupled to the housing via a pin;

the first biasing member is engageable with the first surface protrusion of the second sear at a first distance from the pin; and the second biasing member is engageable with the second surface protrusion of the second sear at a second distance from the pin that is about 1.5 to about 3 times greater than the first distance.

6. The trigger mechanism of claim 1, further comprising fasteners that are rotatable to compress or decompress the first biasing member and the second biasing member.

7. The trigger mechanism of claim 1, wherein the first biasing member and the second biasing member are springs.

8. The trigger mechanism of claim 7, wherein:

the first biasing member comprises a first spring constant; and the second biasing member comprises a second spring constant that differs from the first spring constant.

9. The trigger mechanism of claim 1, further comprising a sear linkage pivotably coupling the first sear and the third sear.

10. A trigger mechanism, comprising:

a housing;

a main sear rotatably coupled to the housing;

an actuator rotatably coupled to the housing, the actuator engageable with the main sear to prevent rotation of the main sear;

a trigger configured to disengage the actuator from the main sear when the trigger is rotated;

a striker sear rotatably coupled to the housing and linked to the main sear;

a striker translatable towards and away from a firearm barrel, wherein the striker sear is releasable from engaging the striker when the actuator is disengaged from the main sear; and a first biasing member and a second biasing member, the first biasing member and the second biasing member each configured to adjustably bias a same portion of the actuator relative to the main sear.

11. The trigger mechanism of claim 10, wherein the first biasing member and the second biasing member are adjustable to vary a force required to rotate the trigger and disengage the actuator from the main sear.

12. The trigger mechanism of claim 11, wherein:

an amount of force exerted on the actuator from the first biasing member is adjustable by rotating a first fastener at least partially disposed within the housing; and an amount of force exerted on the actuator from the second biasing member is adjustable by rotating a second fastener at least partially disposed within the housing.

13. The trigger mechanism of claim 10, wherein a force applied to the actuator by the first biasing member is different from a force applied to the actuator by the second biasing member.

14. The trigger mechanism of claim 10, wherein the first biasing member and the second biasing member comprise coil springs.

15. The trigger mechanism of claim 14, wherein:

the housing forms a first aperture and the first biasing member is at least partially disposed within the first aperture;

the housing forms a second aperture and the second biasing member is at least partially disposed within the second aperture;

at least one of the first biasing member or the second biasing member is retained within the housing between a fastener and the actuator; and the fastener forms a tamper proof interface.

16. A trigger mechanism, comprising:

a housing;

a main sear rotatably coupled to the housing;

a trigger sear rotatably coupled to the housing, the trigger sear engageable with the main sear to prevent rotation of the main sear;

a trigger configured to disengage the trigger sear from the main sear when the trigger is rotated;

a first adjustable biasing member engageable with a contact area on the trigger sear to provide a first amount of rotational resistance corresponding to a minimum trigger pull weight;

a second adjustable biasing member engageable with the contact area on the trigger sear to provide a second amount of rotational resistance corresponding to an additional trigger pull weight accumulative to the minimum trigger pull weight; and a trigger sear pin rotatably coupling the trigger sear to the housing, wherein:

the contact area comprises a first contact point for the first adjustable biasing member and a second contact point for the second adjustable biasing member;

the first contact point is a first distance from the trigger sear pin and the second contact point is a second distance from the trigger sear pin that is less than the first distance.

17. The trigger mechanism of claim 16, wherein:

the first amount of rotational resistance is zero; and the second amount of rotational resistance is non-zero.

18. The trigger mechanism of claim 16, wherein at least one of:

the first amount of rotational resistance is adjustable via rotation of a first fastener to increase or decrease a bias of the first biasing member; or the second amount of rotational resistance is adjustable via rotation of a second fastener to increase or decrease a bias of the second biasing member.

* * * * *